US010861430B1

(12) United States Patent
Stanton et al.

(10) Patent No.: US 10,861,430 B1
(45) Date of Patent: Dec. 8, 2020

(54) GUITAR APPARATUS FOR SWITCHING PICKUPS

(71) Applicant: JKR Guitars, LLC, Shelby, OH (US)

(72) Inventors: Kyle R. Stanton, Shelby, OH (US); Joseph Chapman, Bellville, OH (US); George F. Fleiner, Bellville, OH (US)

(73) Assignee: JKR Guitars, LLC, Shelby, OH (US)

( * ) Notice: Subject to any disclaimer, the term of this patent is extended or adjusted under 35 U.S.C. 154(b) by 0 days.

(21) Appl. No.: 16/601,485

(22) Filed: Oct. 14, 2019

Related U.S. Application Data

(60) Provisional application No. 62/745,930, filed on Oct. 15, 2018.

(51) Int. Cl.
*G10H 3/18* (2006.01)
*G10H 1/34* (2006.01)

(52) U.S. Cl.
CPC ..... *G10H 3/183* (2013.01); *G10H 1/342* (2013.01); *G10H 3/181* (2013.01); *G10H 3/182* (2013.01); *G10H 2220/461* (2013.01)

(58) Field of Classification Search
CPC ..... G10H 3/183; G10H 3/18; G10H 3/181; G10H 3/182; G10H 1/342; G10H 2220/461
USPC ..... 84/726, 743
See application file for complete search history.

(56) References Cited

U.S. PATENT DOCUMENTS 3,418,435 A * 12/1968 Norris ..... G11B 3/38 369/86
3,544,696 A 12/1970 Broussard
3,780,202 A * 12/1973 Law ..... G10H 3/183 84/726
3,869,952 A * 3/1975 Rowe ..... G10H 3/183 84/727
4,394,830 A 7/1983 Damiano
4,501,186 A * 2/1985 Ikuma ..... G10H 3/182 84/726
4,632,003 A * 12/1986 Kopp ..... G10D 1/085 84/267
4,869,144 A * 9/1989 Lieber ..... G10H 3/183 84/726
5,012,716 A * 5/1991 Pagelli ..... G10H 3/182 84/727
5,292,999 A * 3/1994 Tumura ..... G10H 3/181 84/728
5,335,576 A * 8/1994 Hayashi ..... G10H 3/181 84/727
5,637,823 A 6/1997 Dodge
D393,275 S * 4/1998 Andrenacci ..... D17/20
5,767,432 A 6/1998 Randolph
(Continued)

*Primary Examiner* — David S Warren
*Assistant Examiner* — Christina M Schreiber
(74) *Attorney, Agent, or Firm* — Medley, Behrens & Lewis, LLC

(57) ABSTRACT

An apparatus for selecting between sets of pickups for a stringed musical instrument including a top plate with two sets of pickups embedded therein that is rotationally attached to a back plate. The apparatus includes an electrical connector that enables electrical connection between the pickups and the instrument. The apparatus further includes attachment structure enabling fastening of the instrument to a backside of the instrument. The apparatus is configured to extend through a body of the instrument such that the top plate is adjacent strings of the instrument.

20 Claims, 9 Drawing Sheets

(56) References Cited

U.S. PATENT DOCUMENTS

| | | | | |
|---|---|---|---|---|
| 6,043,422 | A | 3/2000 | Chapman | |
| 6,111,184 | A * | 8/2000 | Cloud | G10H 3/182 84/723 |
| 6,162,984 | A | 12/2000 | Engard | |
| 7,015,390 | B1 | 3/2006 | Rogers | |
| 7,060,888 | B2 * | 6/2006 | Spalt | G10H 3/183 84/727 |
| 7,285,714 | B2 | 10/2007 | Juszkiewicz et al. | |
| 9,093,058 | B1 | 7/2015 | Harris | |
| 9,847,080 | B2 | 12/2017 | Chapman | |
| 2003/0164080 | A1 | 9/2003 | Childress | |
| 2004/0245080 | A1 | 12/2004 | Turner | |
| 2005/0120871 | A1 * | 6/2005 | Spalt | G10H 3/183 84/743 |
| 2006/0174755 | A1 | 8/2006 | Ito | |
| 2007/0056435 | A1 * | 3/2007 | Juszkiewicz | G10H 3/181 84/726 |
| 2011/0290099 | A1 | 12/2011 | Franklin et al. | |
| 2012/0312146 | A1 * | 12/2012 | Bekerman | G10H 3/143 84/726 |
| 2013/0263721 | A1 | 10/2013 | Shavit | |
| 2013/0276621 | A1 * | 10/2013 | Bekerman | G10H 1/32 84/726 |
| 2014/0251117 | A1 * | 9/2014 | Angelopoulos | G10H 3/143 84/726 |
| 2015/0294659 | A1 * | 10/2015 | Chapman | G10H 3/14 84/743 |
| 2016/0049142 | A1 * | 2/2016 | Radmacher | G10H 3/181 84/726 |
| 2018/0061389 | A1 * | 3/2018 | Berg | G10D 1/085 |
| 2018/0211645 | A1 * | 7/2018 | Abe | G10H 3/18 |

* cited by examiner

GUITAR APPARATUS FOR SWITCHING PICKUPS

CROSS-REFERENCE TO RELATED APPLICATION

The present application claims priority to U.S. Provisional Application No. 62/745,930, filed on Oct. 15, 2018, and entitled "GUITAR APPARATUS FOR SWITCHING PICKUPS". The entirety of this application is incorporated herein by reference.

BACKGROUND

Electric guitars are musical instruments capable of producing a wide range of sounds using an amplification device. Conventionally, an electric guitar is built with one or more permanently installed pickups which are positioned beneath metal strings of the guitar. The pickups are configured to convert mechanical vibrations of strings into electrical signals. These installed pickups generate a particular tonality depending on the type and arrangement of the pickups. However, many musicians desire to play guitars that generate tonalities beyond the limit of a single guitar. Conventionally, in order to achieve a different tonality, the musician had to select a different guitar with the desired tonality, which can be time consuming and cumbersome, especially during a guitar performance.

SUMMARY

The following is a brief summary of subject matter that is described in greater detail herein. This summary is not intended to be limiting as to the scope of the claims.

In an exemplary embodiment, described herein is an apparatus for selecting between sets of pickups for a stringed musical instrument (such as an electric guitar). The apparatus includes a top plate and a back plate, wherein the top plate includes two sets of pickups embedded on a first side of the top plate, and further wherein when the apparatus is installed in the musical instrument, the back plate is flushed with a backside of the musical instrument (e.g., the side of the musical instrument that is opposite a stringed side of the instrument). The top plate is rotationally attached to the back plate. The apparatus further includes an electrical connector that corresponds to an electrical link of the instrument. The electrical connector enables a selective electrical connection between the pickups and the instrument. The apparatus also includes an attachment structure that corresponds to an attachment portion of the backside the instrument opposite a stringed side of the instrument. The attachment structure is configured to fasten the apparatus to the instrument. The top plate and the back plate may be arranged such that when the apparatus is fastened to the instrument, the apparatus extends through a body of the instrument such that the first side of the top plate is immediately beneath strings of the instrument, and flush with the stringed side of the instrument.

A method of selecting between different pickups includes securing an electronic pickup apparatus to a backside of a stringed musical instrument opposite a stringed side of the instrument. The method further includes rotating a top plate of the apparatus to align a set of pickups embedded in the top plate with strings of the instrument. Aligning the set of pickups establishes an electrical connection between the set of pickups and an electrical connector of the apparatus such that an electrical signal generated by the set of pickups transmits to the electrical connector.

Further, in accordance with various aspects, described herein is an apparatus for selecting between sets of pickups for a stringed musical instrument. The apparatus includes a top plate with two sets of pickups embedded on a first side of the top plate. The apparatus further includes a back plate that is separated from the top plate by a gap. The top plate is rotationally attached to the back plate. The apparatus further includes a first mid-plate between the top plate and the back plate. The first mid-plate is coupled to the top plate such that the first mid-plate rotates in unison with the top plate. The apparatus also includes a second mid-plate between the first mid-plate and the back plate. The second mid-plate is coupled to the back plate such that the first mid-plate rotates relative to the second mid-plate. The first mid-plate includes an electrical contact on a side of the first mid-plate that faces the back plate and the second mid-plate includes a corresponding electrical contact on a side of the second mid-plate that faces the top plate. The electronic contact on the first mid-plate is electronically connected to a pickup. The apparatus additionally includes an electrical connector that corresponds to an electrical link of the instrument. The electronic contact on the second mid-plate is electronically connected to the electronic connector. The electrical connector enables a selective electrical connection between the pickups and the instrument. The apparatus yet further includes an attachment structure that corresponds to an attachment portion of a backside the instrument opposite a stringed side of the instrument. The attachment structure enables fastening of the apparatus to the instrument. The top plate and the back plate are arranged such that when the apparatus is fastened to the instrument, the apparatus extends through the body such that the first side of the top plate is adjacent strings of the instrument.

The above summary presents a simplified summary in order to provide a basic understanding of some aspects of the apparatus and/or methods discussed herein. This summary is not an extensive overview of the apparatus and/or methods discussed herein. It is not intended to identify key/critical elements or to delineate the scope of such apparatus and/or methods. Its sole purpose is to present some concepts in a simplified form as a prelude to the more detailed description that is presented later.

DETAILED DESCRIPTION

Figure 1:
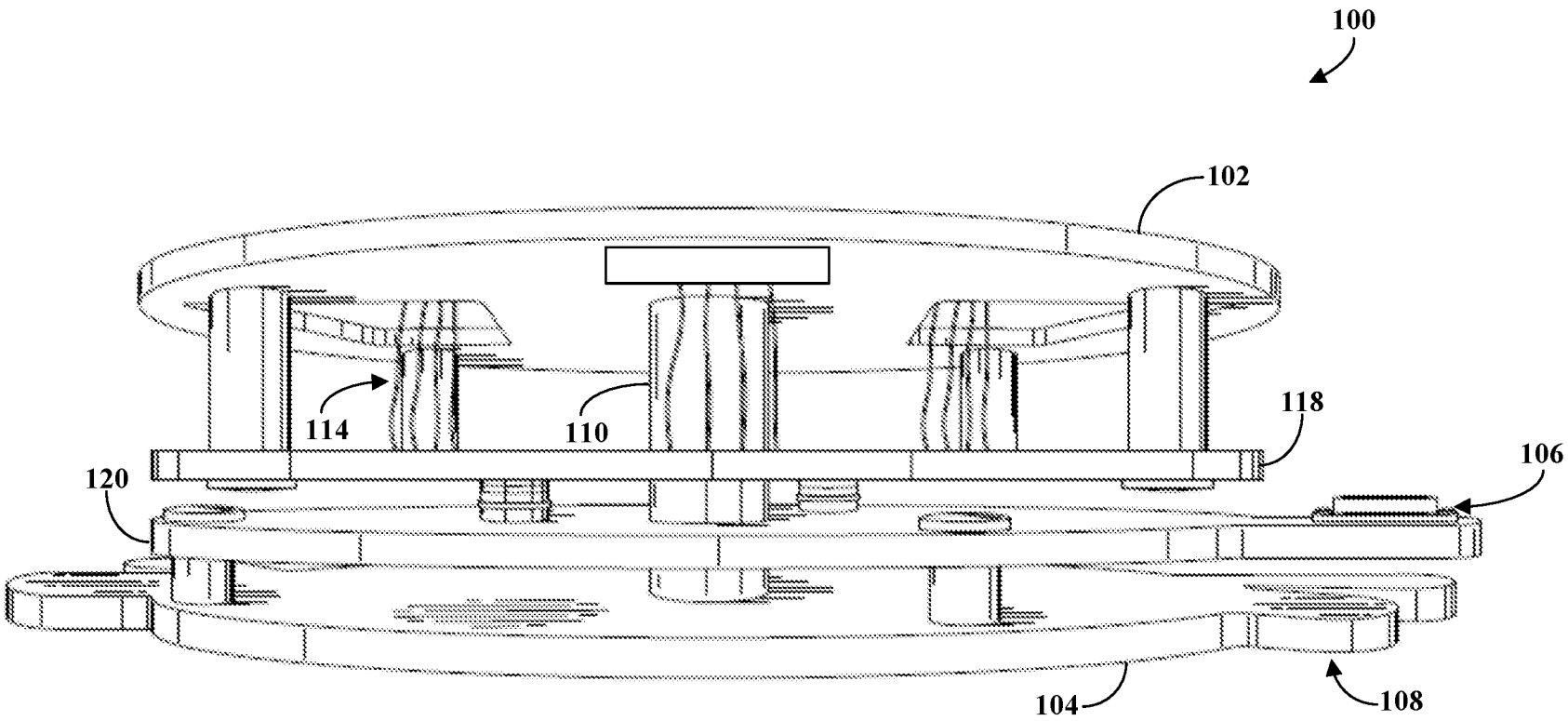
FIG. 1 illustrates an exemplary apparatus for selecting sets of pickups.

Various technologies pertaining to an apparatus that is configured to allow a musician to dynamically alter a set of pickups for an electric stringed instrument (e.g., an electric guitar) are now described with reference to the drawings, wherein like reference numerals are used to refer to like elements throughout. In the following description, for purposes of explanation, numerous specific details are set forth in order to provide a thorough understanding of one or more aspects. It may be evident, however, that such aspect(s) may be practiced without these specific details.

In reference to the disclosure herein, for purposes of convenience and clarity only, directional terms, such as, top, bottom, left, right, up, down, upper, lower, over, above, below, beneath, rear, and front, may be used. Such directional terms should not be construed to limit the scope of the features described herein in any manner. It is to be understood that embodiments presented herein are by way of example and not by way of limitation. The intent of the following detailed description, although discussing exemplary embodiments, is to be construed to cover all modifications, alternatives, and equivalents of the embodiments as may fall within the spirit and scope of the features described herein.

Moreover, the term "or" is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Additionally, as used herein, the term "exemplary" is intended to mean serving as an illustration or example of something and is not intended to indicate a preference.

Further, as used herein, the term "stringed instrument" is intended to encompass any musical instrument that produces sound from vibrating strings when a performer plays or sounds the strings in some manner. The instrument can include, but is not limited to, a guitar, a bass guitar, a violin, a viola, a cello, a banjo, a mandolin, a ukulele, and/or the like. While the examples set forth herein pertain to a guitar, it is to be understood that the examples are not intended to be limiting.

Disclosed is an apparatus that allows a guitarist to switch between sets of pickups at will. The apparatus is configured to be inserted into a backside of a guitar body, such that the system can be inserted into the guitar body without requiring the strings to be removed. The guitarist can then rotate a top plate of the apparatus adjacent the strings to select between different sets of pickups.

Turning to FIG. 1, illustrated is one embodiment of an apparatus 100 for selecting between sets of pickups for a stringed instrument. As illustrated in FIG. 1, the apparatus 100 includes a top plate 102, a back plate 104, an electrical connector 106, and/or attachment structure 108. The attachment structure 108 can be used to attach the apparatus 100 to the stringed instrument. The top plate 102 includes sets of pickups that are embedded therein. The top plate 102, when the apparatus 100 is coupled to the stringed instrument, can be rotated to select between the sets of pickups. The top plate 102 can subsequently be rotated again to select a different set of pickups without having to remove the apparatus 100 from the stringed instrument. By allowing different sets of pickups to be selected while attached to the stringed instrument, the apparatus 100 allows for switching between sets of pickups in the stringed instrument without requiring the stringed instrument to be disassembled to replace one set of pickups with another set.

The top plate 102 and the back plate 104 may be rotationally connected such that the top plate 102 and/or the back plate 104 can rotate relative to the other. The top plate 102 and the back plate 104 may be connected via any suitable connection structure that permits the top plate 102 and/or the back plate 104 to rotate. The connection structure can further define an axis of rotation about which the top plate 102 and/or the back plate 104 rotates. For example, in the illustrated embodiment, the top plate 102 is attached to the back plate 104 via a post 110 that extends between the top plate 102 and the back plate 104. The post 110 may define the axis of rotation for the top plate 102 and/or the back plate 104. The back plate 104 may include a recess at its center and the post 110 may rest in the recess. The post 110 may further include a hollow region and a fastener is employed to secure the top plate 102 to the post 110 while allowing the top plate 102 to rotate about the post 110.

Figure 8:
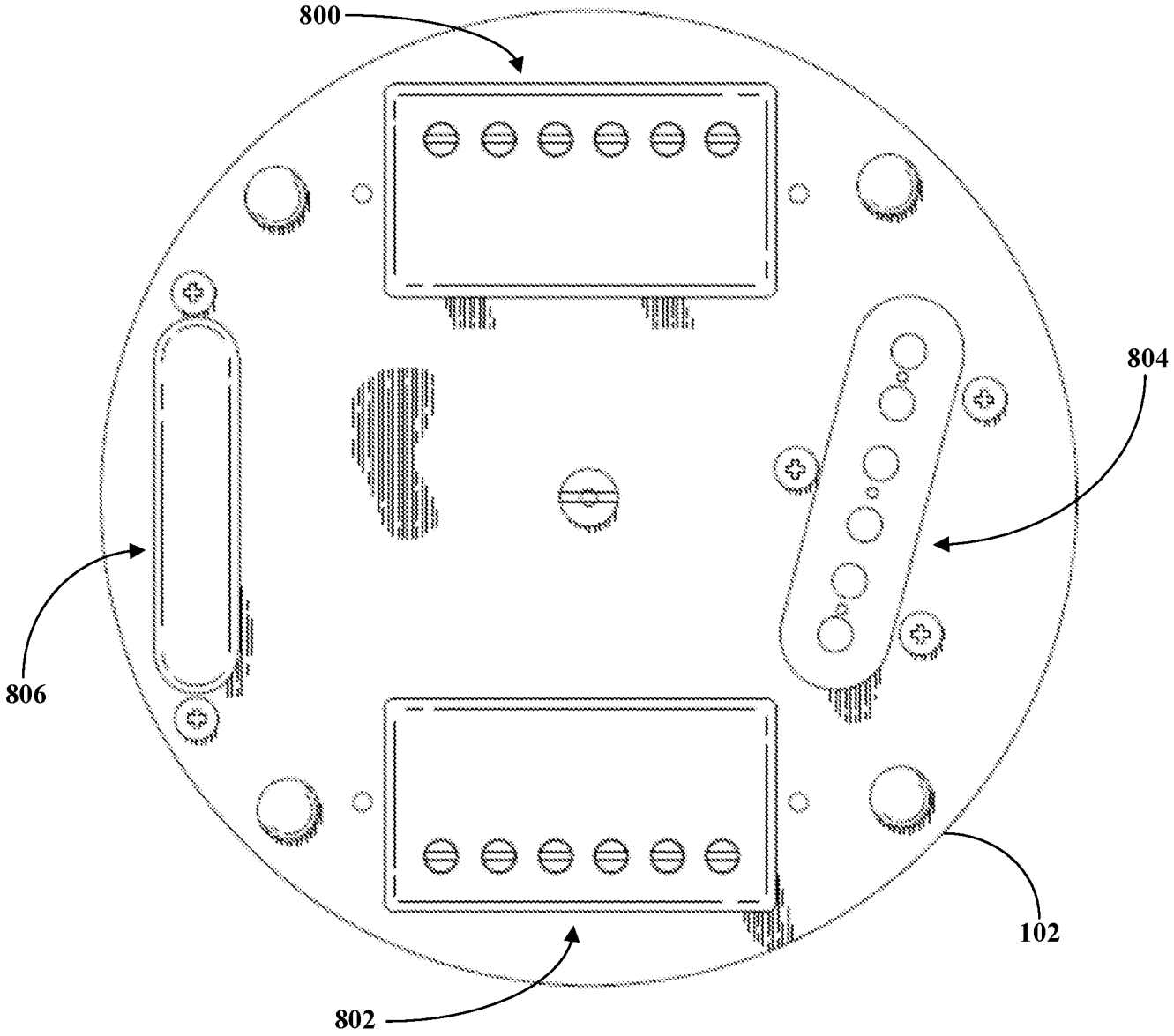
FIG. 8 illustrates another portion of an exemplary apparatus for selecting sets of pickups.

The top plate 102 further includes one or more sets of pickups. The pickups are configured to capture mechanical vibrations produced by the stringed instrument (e.g., one or more strings of the stringed instrument vibrating) and to convert these to electrical signals. The top plate 102 may include any number of pickups that may be arranged into any number of sets of pickups. For instance, the top plate 102 can include a first pickup 800, a second pickup 802, a third pickup 804, and a fourth pickup 806 (collectively referred to herein as the pickups 800-806) (FIG. 8). Any suitable number of pickups 800-806 may be included in each set and may vary between sets. For instance, a first set may comprise two pickups while a second set may comprise three pickups. Further, each pickup 800-806 may be of any suitable shape and/or size and may be uniform or vary within a set. Moreover, each pickup 800-806 within a set may be placed in any suitable orientation and/or spacing on the top plate 102.

Each pickup 800-806 may be made of any suitable material. For instance, the pickup 800-806 can comprise a magnetic pickup, a piezoelectric pickup, an instance electret pickup, a condenser microphone pickup, and/or the like. By way of example, the magnetic pickup can comprise a single-coil pickup, a double-coil pickup (e.g., a humbucker), and/or the like. The same material may be used for each pickup 800-806 within a set or the material may vary.

An electrical signal generated by a pickup 800-806 within a set of pickups can then be amplified to produce a musical sound and/or musical sounds. The electrical signal may be amplified using an instrument amplifier to produce musical sounds through a loudspeaker in a loudspeaker enclosure. The electrical signal may be supplied to the amplifier via any suitable electrical connection. For example, the apparatus 100 may be directly connected to an amplifier. In another example, the apparatus 100 may be connected to circuitry within the stringed instrument which may then be connected to an amplifier.

To that end, as illustrated in FIG. 1, the apparatus 100 may include the electrical connector 106 that can establish an electrical connection between the apparatus 100 and circuitry of the stringed instrument. The electrical connector 106 may correspond to an electrical link of the stringed instrument. Any suitable electrical connector and electrical link combination may be used to link the apparatus 100 to circuitry of the stringed instrument. The electrical connector 106 may be formed and/or attached at any suitable location in the apparatus 100. In the illustrated embodiment, the electrical connector 106 is on a second mid-plate 120 (described in detail below). In another embodiment, the electrical connector 106 can be formed on the back plate 104.

One or more of the pickups 800-806 in the top plate 102 may be connected to the electrical connector 106 such that an electrical signal generated by the pickup 800-806 is transmitted to the circuitry of the stringed instrument. In one example, the connection between the pickup 800-806 and the electrical connector 106 may be constant such that regardless of the position of the pickup 800-806, any generated electrical signal is transmitted to the stringed instrument. However, it may be desirable to selectively transmit electrical signals generated by the pickup 800-806 to the stringed instrument. For instance, where the top plate 102 is rotating from a first set of pickups to a second set of pickups generated electric signals may represent undesired signals.

To this end, the apparatus 100 may include one or more mid-plates located between the top plate 102 and the back plate 104 that can selectively enable and/or disable electrical connection of the pickup 800-806 and the electrical connector 106. The apparatus 100 may include any suitable number of mid-plates. In the illustrated embodiment, the apparatus 100 includes a first mid-plate 118 and a second mid-plate 120 between the top plate 102 and the back plate 104. The second mid-plate 120 may be arranged such that the first mid-plate 118 is between the top plate 102 and the second mid-plate 120.

The first mid-plate 118 may include one or more first electrical contacts on a side of the first mid-plate 118 that faces the back plate 104. A pickup 800-806 may be connected to one or more of the first electrical contacts. The first mid-plate 118 may include any suitable number of first electrical contacts and the number may depend on the number of pickups 800-806. For example, a first electrical contact may be provided for each pickup 800-806.

The second mid-plate 120 may include one or more second electrical contacts on a side of the second mid-plate 120 that faces the top plate 102. The second electrical contacts can be connected to the electrical connector 106. The second mid-plate 120 may include any suitable number of second electrical contacts and the number may depend on the number of first electrical contacts. Electrical connection between the pickup 800-806 and the electrical connector 106 is established when the first electrical contacts contact the second electrical contacts.

The first electrical contacts and/or the second electrical contacts may comprise any suitable structure and/or may be made of any suitable material. In one embodiment, the first electrical contacts and the second electrical contacts are made of the same material. In another embodiment, the first electrical contacts and the second electrical contacts are made of different material. Moreover, the first electrical contacts can be made of similar material or the material may vary. Similarly, the second electrical contacts can be made of similar material or the material may vary.

The first electrical contacts and/or the second electrical contacts may be arranged in any suitable pattern on their respective surface. For example, the first electrical contacts and/or the second electrical contacts are arranged such that electrical connection is established when a set of pickups 800-806 is aligned properly with the strings of the stringed instrument. Thus, electrical signals generated by the pickups 800-806 are transmitted via the electrical connector 106 to internal circuitry of the stringed instrument.

Whereas, when a set of pickups 800-806 is not aligned properly with the strings (e.g., the top plate 104 is rotating), electrical connection is not established. Thus, electrical signal generated by the pickups 800-806 are not transmitted to internal circuitry of the stringed instrument.

In the illustrated embodiment, the first mid-plate 118 may be coupled to the top plate 102 such that as the top plate 102 rotates, the first mid-plate 118 rotates. By comparison, the second mid-plate 120 may be coupled to the back plate 104 such that the first mid-plate 118 rotates relative to the second mid-plate 120 to enable selective formation of an electrical connection between the pickups 800-806 and the electrical connector 106. By selectively controlling when the electrical connection is formed, the apparatus 100 can prevent undesired sound from the stringed instrument from being emitted by the loudspeaker enclosure.

The first mid-plate 118 may be coupled to the top plate 102 via any suitable structure. Moreover, the first mid-plate 118 may be spaced from the top plate 102 to accommodate wiring 114 from the pickups 800-806 to the first electrical contacts. Similarly, the second mid-plate 120 may be coupled to the back plate 104 via any suitable structure. Further, the second mid-plate 120 may be spaced from the back plate 104. This spacing can be used to accommodate wiring 114 where necessary, and to further cause a thickness of the apparatus 100 to match a thickness of a body of the instrument (such that when the apparatus 100 is attached to the instrument, a bottom of the back plate 104 is flush with a backside of the instrument and a top of the top plate 102 is flush with a stringed side of the instrument.

The apparatus 100 may further include structure for grounding the first electrical contacts and/or the second electrical contacts as the top plate 102 rotates between aligned positions. The grounding structure can be used to prevent feedback when the top plate 102 is rotated between aligned positions. Any suitable grounding structure may be employed to prevent feedback. Moreover, the grounding structure may be applied to any suitable location in the apparatus 100, as will be described in detail below.

The first mid-plate 118 and/or the second mid-plate 120 may include an aperture extending therethrough for the post 110 to extend through the first mid-plate 118 and/or the second mid-plate 120. The first mid-plate 118 and/or the second mid-plate 120 may then rotate about the axis formed by the post 110.

The top plate 102, the back 104, the first mid-plate 118, and/or the second mid-plate 120 may take any suitable cross-section shape and may have any suitable dimension. The cross-section and/or dimensions may be similar for the top plate 102, the back 104, the first mid-plate 118, and the second mid-plate 120, or the cross-section and/or dimensions may vary. In the illustrated embodiments, the top plate 102, the back 104, the first mid-plate 118, and/or the second mid-plate 120 have a generally cylindrical cross-section.

To enable simple substitution of a second apparatus with second sets of pickups for the apparatus 100 without having to disassemble the stringed instrument, the apparatus 100 (and the second apparatus) is designed to attach to a backside of the stringed instrument (the side opposite the stringed side) and to pass through the body of the stringed instrument, such that the pickups 800-806 align with the strings. Thus, the apparatus 100 can be removed and replaced with the second apparatus through the backside of the stringed instrument. Accordingly, the strings of the stringed instrument do not need to be detached to swap apparatuses and then reattached and retuned, which can be a time-consuming process.

To this end, the apparatus 100 includes attachment structure 108 that can be employed to attach the apparatus 100 to the backside of the stringed instrument. The backside of the stringed instrument can include an attachment portion that corresponds to the attachment structure 108 permitting attachment of the apparatus 100 to the stringed instrument. In one embodiment, the apparatus 100 can be releasably attached to the stringed instrument. In another embodiment, the apparatus 100 can be permanently attached to the stringed instrument.

In the illustrated embodiment and the following embodiments, the attachment structure 108 is on the back plate 104. However, the attachment structure 108 may be on any suitable part of the apparatus 100, for example the second mid-plate 120. The attachment structure 108 may be formed integrally with the back plate 104 (e.g., formed on a surface of the back plate 104) and/or may be formed separately from the back plate 104 and attached thereto. The attachment structure 108 can take any suitable shape for attaching the apparatus 100 to the stringed instrument. For instance, the attachment structure 108 can comprise one or more magnets and the attachment portion of the stringed instrument can comprise corresponding magnets. In another example, the attachment structure 108 comprises a screw that passes through a hole in the back plate 104 to thread into a screw thread in the stringed instrument to secure the apparatus 100 to the stringed instrument. In yet another example, the attachment structure 108 comprises one or more cam structures that are inserted into and interact with corresponding cam structure in the stringed instrument.

Any suitable material may be used to form the top plate 102, the back 104, the first mid-plate 118, the second mid-plate 120, and/or the attachment structure 108. Similar material may be used for each of the plates 102, 104, 118, and 120 or the material may vary. In one embodiment, the back plate 104 and the attachment structure 108 are made of the same material. In another embodiment, the back plate 104 and the attachment structure 108 are made of different material.

Any suitable arrangement may be employed to provide the first electrical contacts and/or the second electrical contacts to the first mid-plate 118 and/or the second mid-plate 120, respectively. In one embodiment, each electrical contact is separately attached to its respective mid-plate and separately wired to the pickup 800-806 or the electrical connector 106, respectively. In another embodiment, an insert with first electrical contacts and/or the second electrical contacts is attached to the respective first mid-plate 118 and/or the second mid-plate 120, as will be described below.

Figure 2:
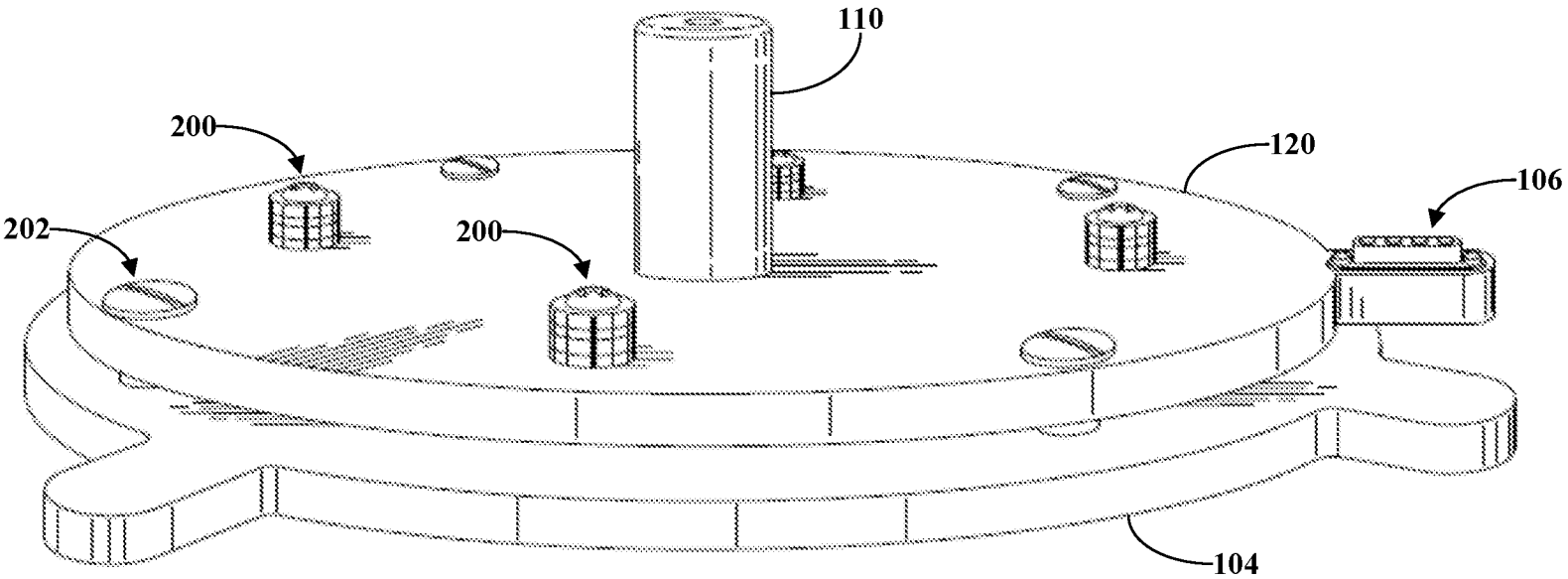
FIG. 2 illustrates a portion of an exemplary apparatus for selecting sets of pickups.

Turning to FIG. 2, illustrated is an embodiment where each second electrical contact 200 is separately attached to the second mid-plate 120. One or more of the second electrical contacts 200 are wired to the electrical connector 106, which in the illustrated embodiment is located on the second mid-plate 120. In the illustrated embodiment, the second mid-plate 120 is coupled to the back plate 104 via one or more bolts 202 that may be used to space the second mid-plate 120 from the back plate 104.

In the illustrated embodiment, the second electrical contacts 200 comprise spring loaded contacts that include a spring configured to press a contact surface of the second electrical contact 200 away from the second mid-plate 120. The spring may further press the contact surface of the second electrical contact 200 into contact with the first electrical contact to establish electrical connection between a pickup 800-806 and the electrical connector 106. The first electrical contact may take any suitable shape for contacting the second electrical contact 200. For example, the first electrical contact may similarly comprise a spring loaded contact. In another embodiment, a contact surface of the first electrical contact may be located within a recess and the spring presses the contact surface of the second electrical contact into the recess and into contact with the first electrical contact. This interaction of the second electrical contact being pressed into the recess can assist in preventing accidental disconnection. More particularly, by pressing the second electrical contact into the recess, disconnection of the first electrical contact and the second electrical contact without application of a purposeful force may be prevented.

Additionally, or alternatively, one or more locking mechanisms may be employed to lock the top plate 102 in a particular alignment. The locking mechanisms may be on the stringed instrument and/or the apparatus 100. The locking mechanism can then be engaged with to permit rotation of the top plate 102 and relocked when a preferred alignment is reached.

Figure 3:
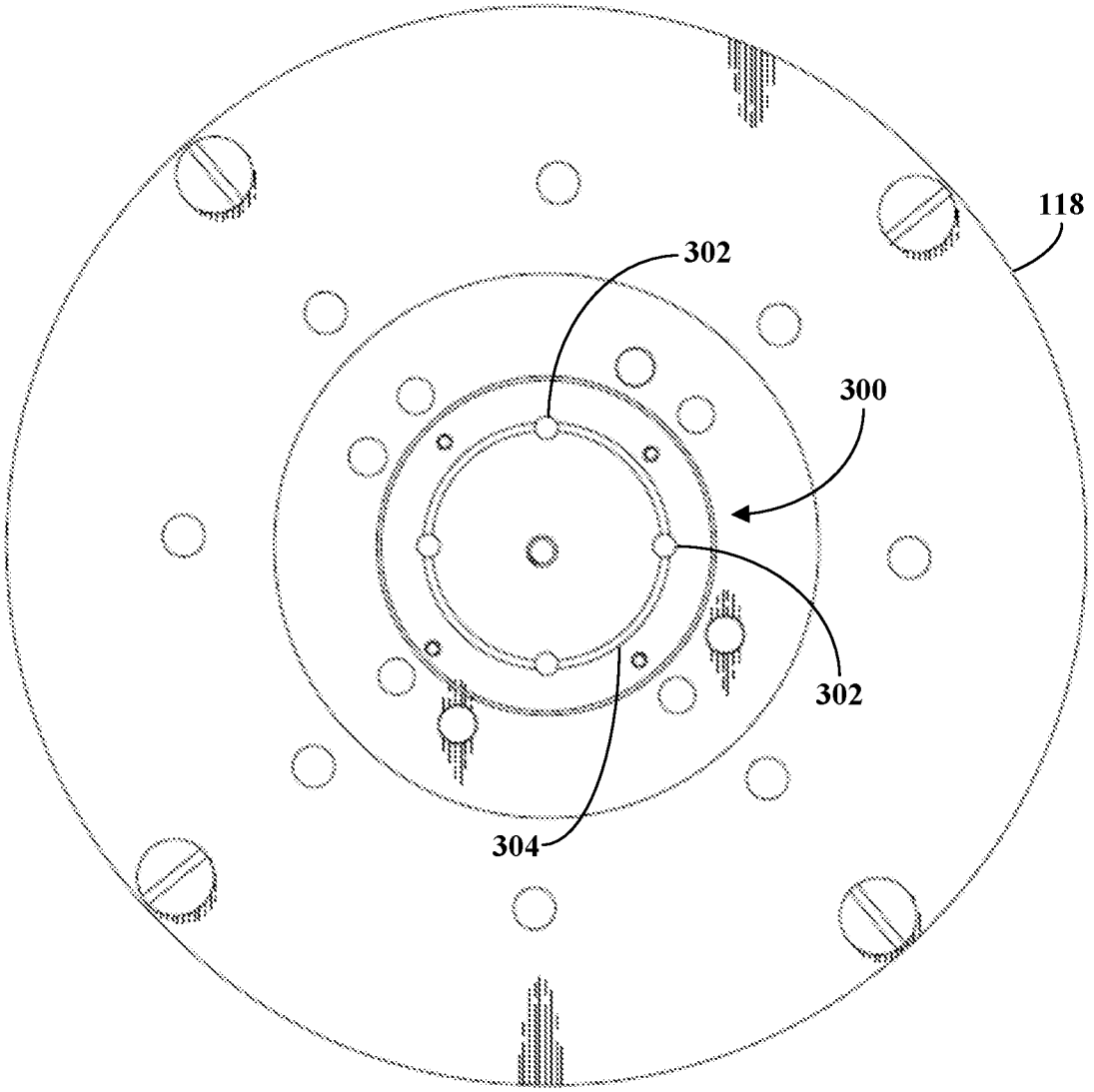
FIG. 3 illustrates a further portion of an exemplary apparatus for selecting sets of pickups.
Figure 4:
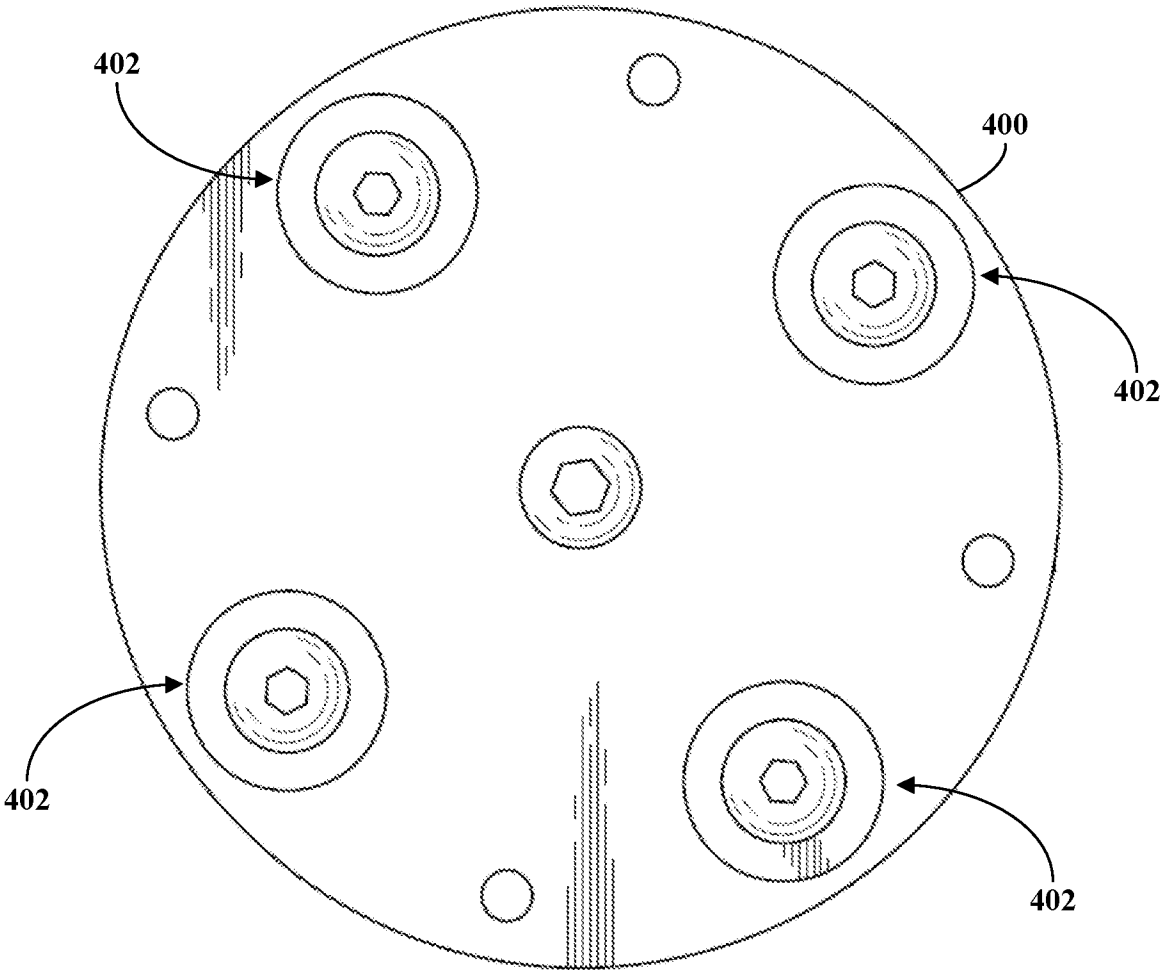
FIG. 4 illustrates another portion of an exemplary apparatus for selecting sets of pickups.

Turning now to FIGS. 3 and 4, illustrated are embodiments of inserts that may be attached to the first mid-plate 118 and/or the second mid-plate 120 to provide the corresponding electrical contacts. The illustrated inserts use a spring-loaded electrical contact and a recessed electrical contact similar to the structure described above.

FIG. 3 illustrates a first insert 300 that may be attached to a corresponding indent in the first mid-plate 118. The first insert 300 may be attached to the first mid-plate 118 via any suitable mechanism, for instance one or more screws or bolts secure the first insert 300 to the first mid-plate 118. An outward facing surface of the first insert 300 may be even with a surface of the first mid-plate 118 or the outward facing surface may be raised or indented with respect to the surface of the first mid-plate 118.

The first insert 300 may include one or more first electrical contacts 302. In the illustrated embodiment, the first insert 300 includes four first electrical contacts 302 that are evenly arranged in a circular pattern. Each first electrical contact 302 is recessed with respect to the outward facing surface of the first insert 300. The first insert 300 may further include an indented pathway 304 that arcs between each recessed first electrical contact 302. The first electrical contacts 302 may be recessed further from the outward facing surface than the pathway 304, such that the recessed first electrical contacts 302 act as temporary holders of the second electrical contacts 402 (FIG. 4). The first insert 300 may further include an aperture to allow the post 110 to extend therethrough.

FIG. 4 illustrates a second insert 400 that may be attached to a corresponding indent in the second mid-plate 120. The second insert 400 includes one or more second electrical contacts 402. The second electrical contacts 402 may be spring-loaded such that when assembled together the second electrical contacts are pushed into the recesses of the first insert 300. Similar to the first insert 300, the second insert 400 may include an aperture to allow the post 110 to extend therethrough.

Figure 5:
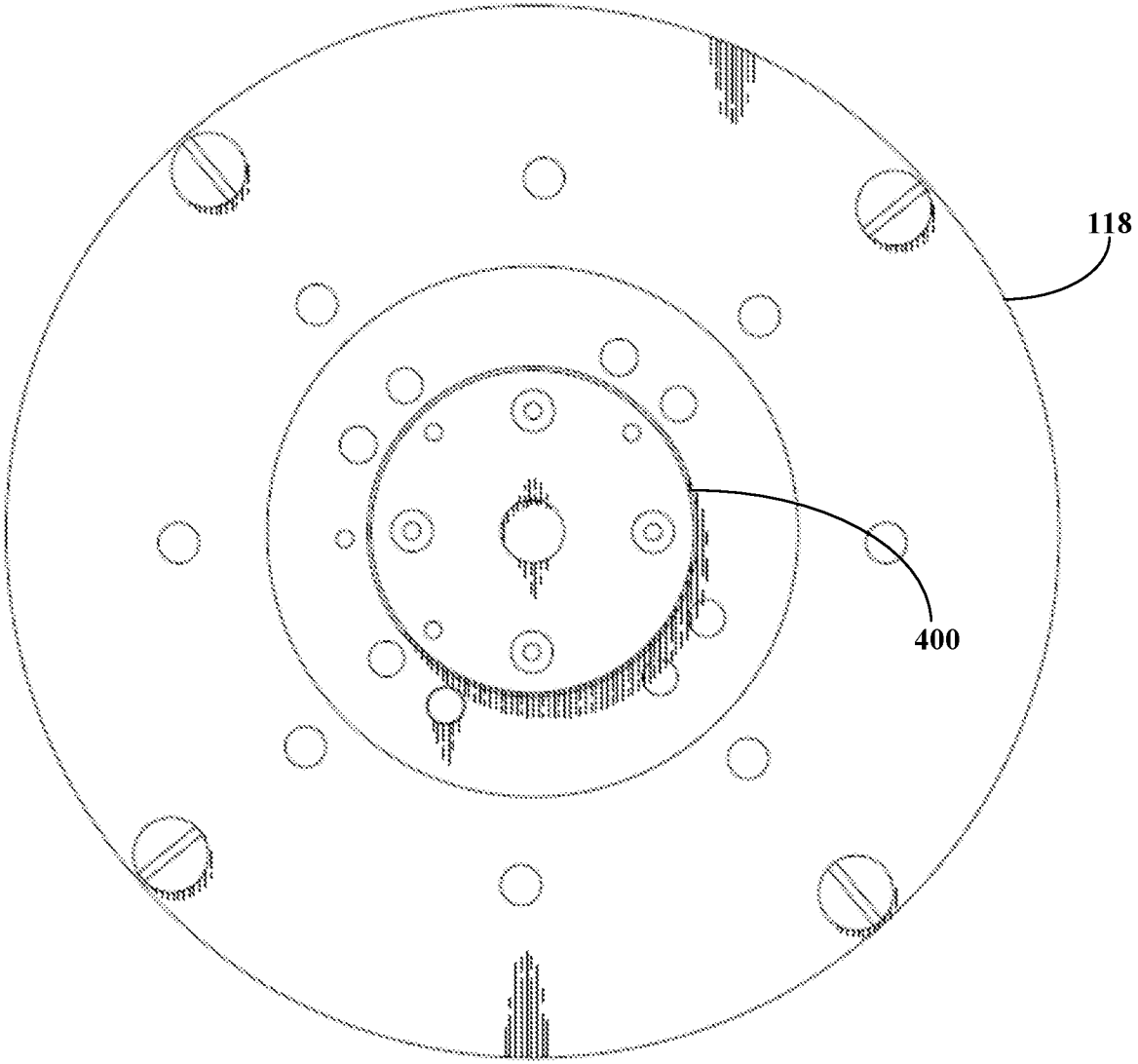
FIG. 5 illustrates a yet further portion of an exemplary apparatus for selecting sets of pickups.

As illustrated in FIG. 5, the first insert 300 and the second insert 400 may be arranged and aligned such that second electrical contacts 402 are either in contact with the recessed first electrical contact 302 or the indented pathway 304 while the top plate 102 is rotated. More particularly, as the top plate 102 and the coupled first mid-plate 118 rotate, the attached first insert 300 rotates causing a second electrical contact 402 to travel from one first electrical contact 302 along the indented pathway 304 to an adjacent first electrical contact 302. Additionally, the indented pathway 304 may be grounded such that as the second electrical contact 402 travels along the indented pathway 304, the second electrical contact 402 is grounded to prevent feedback. The rear side of the second electrical contacts 402 may include structure that allow the second electrical contacts to be wired to the electrical connector 106.

Figure 6:
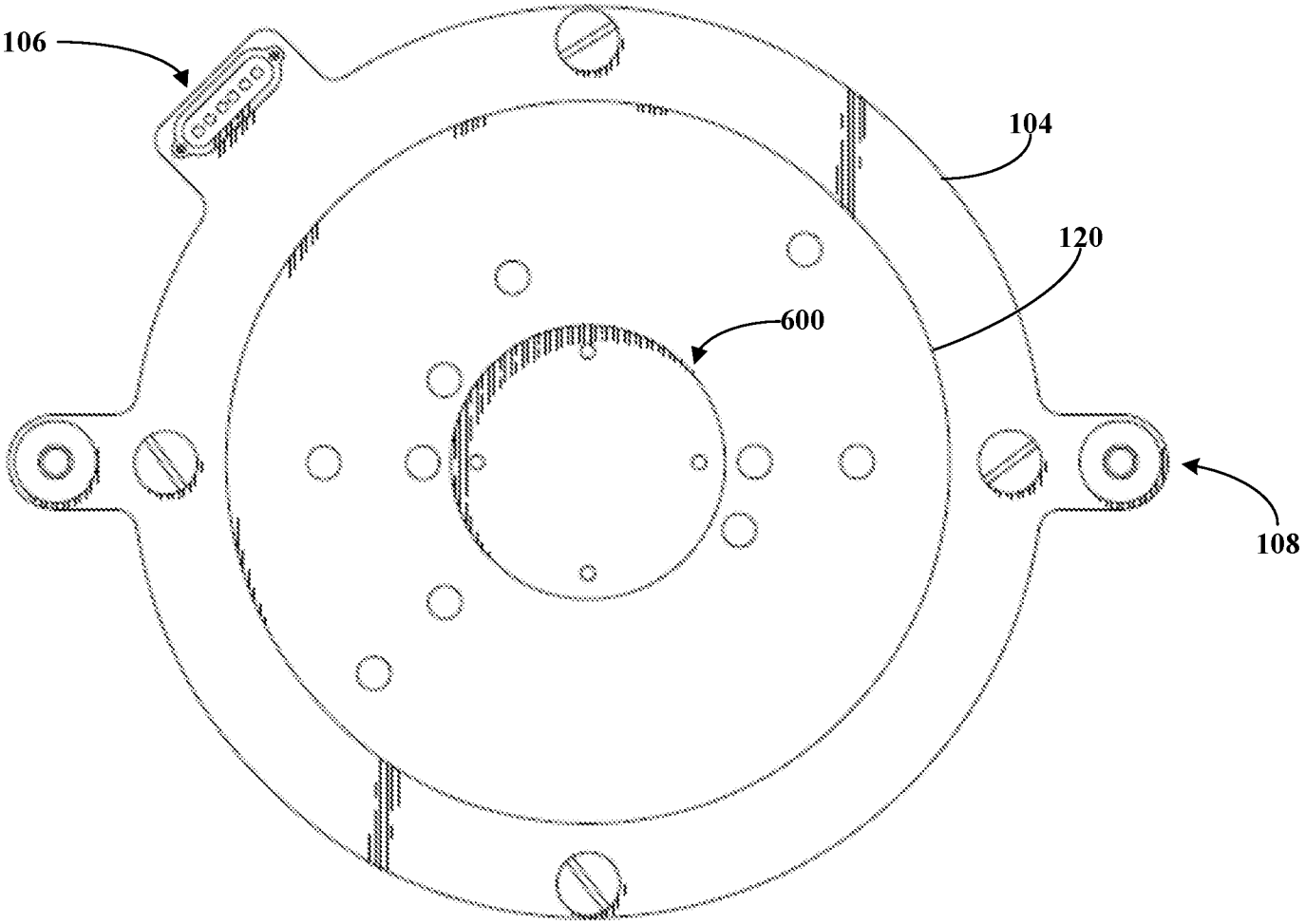
FIG. 6 illustrates yet another portion of an exemplary apparatus for selecting sets of pickups.

FIG. 6 illustrates an embodiment of a coupled back plate 104 and second mid-plate 120. The second mid-plate 120 includes an indent 600 configured to receive an insert (e.g., the second insert 400). The insert may be attached to the second mid-plate 120 in the indent 600 via any suitable mechanism, for instance one or more screws or bolts secure the insert to the second mid-plate 120. Further, FIG. 6 illustrates an embodiment where the electrical connector 106 is attached to the back plate 104. However, it is conceivable that the electrical connector 106 may be located on the second mid-plate 120 similar to the above described embodiments. FIG. 6 additionally illustrates an embodiment where the attachment structure 108 comprises magnets.

Figure 7:
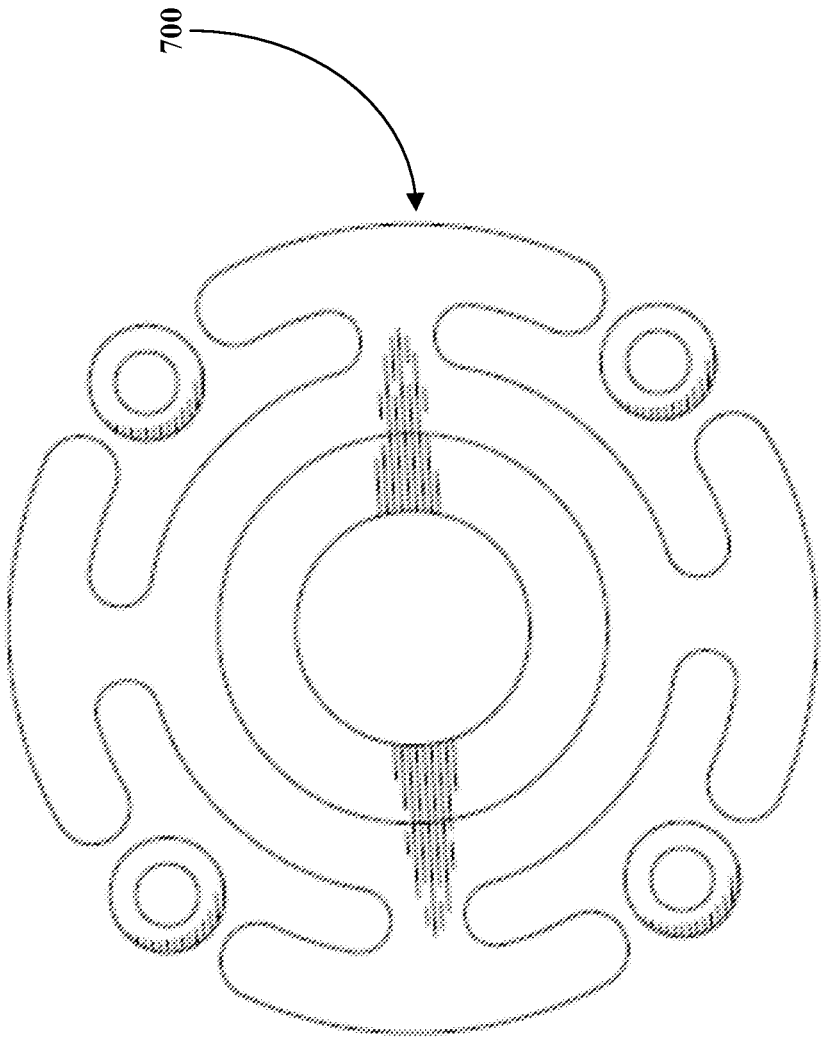
FIG. 7 illustrates a further portion of an exemplary apparatus for selecting sets of pickups.

Turning to FIG. 7, illustrated is another embodiment of a grounding structure that may be employed to prevent feedback as the top plate 102 is rotated between sets of pickups 800-806. The illustrated grounding structure comprises a metal sheet 700 that can be attached to the first mid-plate 118 and/or the second mid-plate 120 to ground an electrical contact during rotation. The metal sheet 700 is shaped to follow a path the electrical contact would travel along during rotation. In this manner, the metal sheet 700 may prevent feedback from the electrical contact during rotation.

FIG. 8 illustrates an exemplary top plate 102 with various sets of pickups installed thereon. For instance, the top plate 102 includes a first pickup 800, a second pickup 802, a third pickup 804, and a fourth pickup 806 (collectively referred to herein as the pickups 800-806). The pickups 800-806 may comprise any suitable pickup and/or one or more of the pickups 800-806 may vary. For example, the pickups can comprise a Lace sensor pickup, a single coil pickup, a P-90 pickup, a humbucker pickup, and/or the like.

In the illustrated embodiment, the pickups 800-806 are arranged into two sets of pickups. A first set of pickups comprising the first pickup 800 and the second pickup 802 and a second set of pickups comprising the third pickup 804 and the fourth pickup 806. The rotating nature of the top plate 102 allows a user to select between the two sets of pickups without having to change instruments. For instance, the top plate 102 can be rotated in a clockwise and/or a counterclockwise direction to select the desired set of pickups.

The pickups 800-806 may be selected and combined to generate different tonalities. For instance, the pickups 800 and 802 in the first set may both be humbuckers to generate a humbucker tonality when the first set of pickups is aligned with the strings of the stringed instrument. Moreover, different pickups may be selected for the pickups in a set to generate different tonalities based on the order of the pickups. For example, the third pickup 804 can comprise a first type and the fourth pickup 806 can comprise a different second type. When the top plate 102 is aligned such that the third pickup 804 is closer to a neck of the stringed instrument, a first tonality is generated. Whereas, when the top plate 102 is aligned such that the fourth pickup 806 is close to the neck of the stringed instrument, a second tonality is generated. By selecting different types and/or orientations for the pickups in a set of pickups, more tonalities can be created. Further, in an exemplary embodiment, one or more of the pickups 800-806 can be on a track, such that a distance between two pickups in a set of pickups can be altered by a player of the instrument. For example, the pickup 800 may be on a track such that the pickup 800 can be moved closer or further away from the pickup 802, as desired by the player of the instrument.

Figure 9:
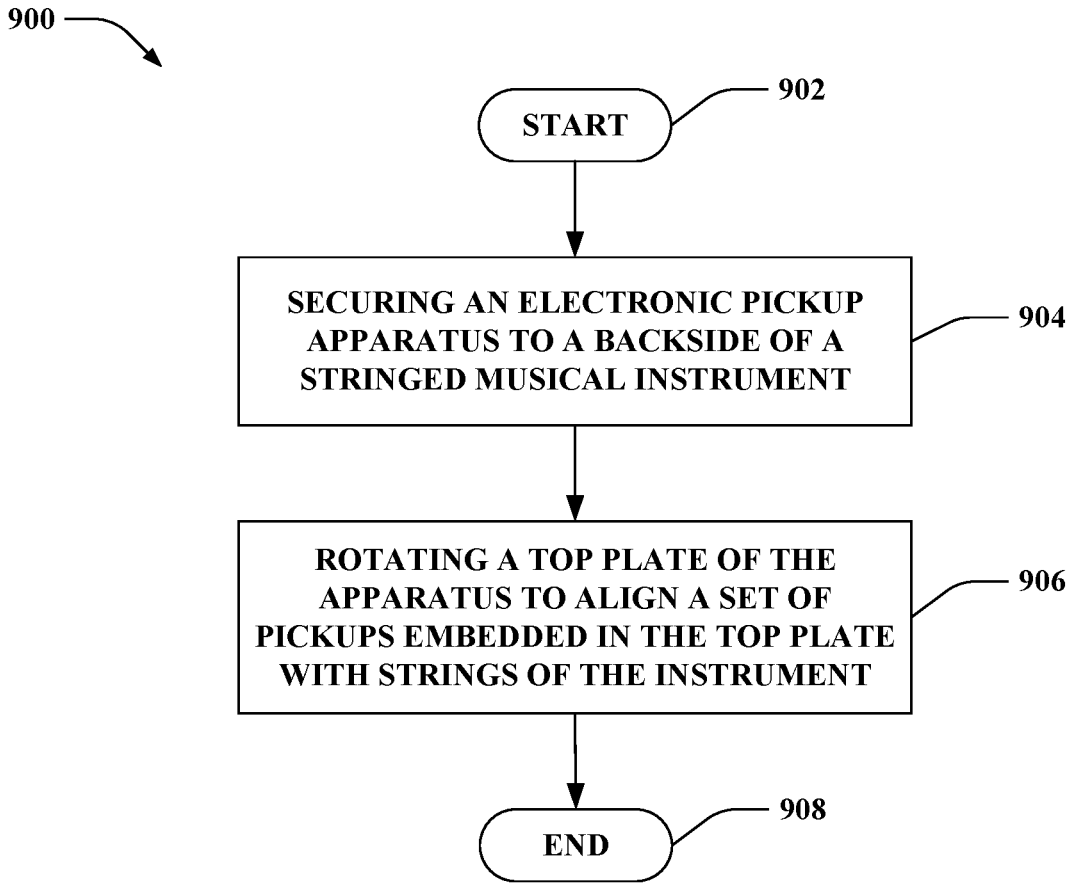
FIG. 9 is a flow diagram that illustrates an exemplary methodology for selecting sets of pickups.

FIG. 9 illustrates an exemplary methodology relating to selecting between different pickups for a stringed instrument. While the methodology is shown as being a series of acts that are performed in a sequence, it is to be understood and appreciated that the methodology is not limited by the order of the sequence. For example, some acts can occur in a different order than what is described herein. In addition, an act can occur concurrently with another act. Further, in some instances, not all acts may be required to implement a methodology described herein.

Referring now to FIG. 9, an exemplary methodology 900 for selecting pickups is illustrated. The methodology 900 starts at 902, and at 904, an electronic pickup apparatus is secured to a backside of a stringed musical instrument opposite a stringed side of the instrument. At 906, a top plate of the apparatus is rotated to align a set of pickups embedded in the top plate with strings of the instrument. Aligning the set of pickups establishes an electrical connection between the set of pickups and an electrical connector of the apparatus such that an electrical signal generated by the set of pickups transmits to the electrical connector. The methodology 900 concludes at 908.

In an embodiment of the methodology 900, the step of securing the apparatus to the backside of the instrument comprises attaching the electrical connector of the apparatus to a corresponding electrical link of the instrument.

In another embodiment, the methodology 900 further includes rotating the top plate of the apparatus to align a second set of pickups embedded in the top plate with strings of the instrument.

In a further embodiment, the methodology 900 further includes removing the apparatus from the instrument by pressing a top plate of the apparatus toward the backside of the instrument. In a further step, a second pickup apparatus is secured to the backside of the instrument. In a version of this embodiment, the methodology 900 includes rotating a second top plate of the second apparatus to align a third set of pickups embedded in the second top plate with strings of the instrument What has been described above includes examples of one or more embodiments. It is, of course, not possible to describe every conceivable modification and alteration of the above devices or methodologies for purposes of describing the aforementioned aspects, but one of ordinary skill in the art can recognize that many further modifications and permutations of various aspects are possible. Accordingly, the described aspects are intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An apparatus for selecting between sets of pickups for a stringed musical instrument comprising:

a top plate, wherein the top plate includes two sets of pickups embedded on a first side of the top plate;

a back plate, wherein the top plate is rotationally attached to the back plate;

an electrical connector, wherein the electrical connector corresponds to an electrical link of the instrument, wherein the electrical connector enables a selective electrical connection between the pickups and the instrument; and an attachment structure, wherein the attachment structure corresponds to an attachment portion of a backside of the instrument opposite a stringed side of the instrument, wherein the attachment structure enables fastening of the apparatus to the instrument, wherein the top plate and the back plate are arranged such that when the apparatus is fastened to the instrument, the apparatus extends through a body of the instrument such that the first side of the top plate is adjacent strings of the instrument and the backplate is flush with the backside of the instrument, wherein the apparatus is removable from the body of the instrument by way of the backside of the instrument.

2. The apparatus of claim 1, wherein the attachment structure comprises a magnet.

3. The apparatus of claim 1, further comprising a mid-plate between the top plate and the back plate, wherein the mid-plate is coupled to the top plate such that mid-plate rotates in unison with the top plate.

4. The apparatus of claim 3, further comprising:

a second mid-plate between the mid-plate and the back plate, wherein the second mid-plate is coupled to the back plate such that the mid-plate rotates relative to the second mid-plate, wherein the mid-plate includes an electrical contact on a side of the mid-plate that faces the back plate and the second mid-plate includes a corresponding electrical contact on a side of the second mid-plate that faces the top plate, wherein the electronic contact on the mid-plate is electronically connected to an pickup and the electronic contact on the second mid-plate is electronically connected to the electrical connector.

5. The apparatus of claim 4, wherein the electrical contact on the second mid-plate comprises a spring-loaded electrical contact, wherein the electrical contact on the mid-plate is positioned in a recess in the mid-plate such that an electrical connection is formed between the second mid-plate and mid-plate when a spring of the spring-loaded electrical contact presses the contact on the second mid-plate into the recess.

6. The apparatus of claim 4, further comprising:

a plurality of electrical contacts arranged about the side of the mid-plate that faces the back plate, wherein the plurality of electrical contacts includes the electrical contact on the mid-plate, wherein each set of pickups is electronically connected to at least one electrical contact from the plurality of electrical contacts; and a plurality of electrical contacts that correspond to the plurality of electrical contacts on the mid-plate arranged about the side of the second mid-plate that faces the top plate, wherein the plurality of electrical contacts include the electrical contact on the second mid-plate.

7. The apparatus of claim 4, wherein a portion of the mid-plate surrounding the electrical contact is grounded.

8. The apparatus of claim 1, wherein electrical connection between the pickups and the instrument is established when a set of pickups from the two sets of pickups is aligned with strings of the instrument.

9. The apparatus of claim 1, wherein a first set of pickups is different from a second set of pickups.

10. The apparatus of claim 1, wherein the top plate is attached to the back plate via a post extending therebetween, wherein the post defines an axis of rotation of the top plate.

11. The apparatus of claim 1, further comprising a locking mechanism configured to selectively retain the top plate in a preferred position.

12. The apparatus of claim 1, wherein the top plate and the back plate have a circular cross-section.

13. A method of selecting between different pickups comprising:

securing an electronic pickup apparatus to a backside of a stringed musical instrument opposite a stringed side of the instrument by passing the electronic pickup apparatus through the backside of the instrument, wherein a backplate of the electronic pickup apparatus is flush with the backside of the instrument when the electronic pickup apparatus is secured to the backside of the stringed musical instrument; and rotating a top plate of the apparatus to align a set of pickups embedded in the top plate with strings of the instrument, wherein aligning the set of pickups establishes an electrical connection between the set of pickups and an electrical connector of the apparatus such that an electrical signal generated by the set of pickups transmits to the electrical connector.

14. The method of claim 13, wherein the step of securing the apparatus to the backside of the instrument comprises attaching the electrical connector of the apparatus to a corresponding electrical link of the instrument.

15. The method of claim 13, further comprising:

rotating the top plate of the apparatus to align a second set of pickups embedded in the top plate with strings of the instrument.

16. The method of claim 13, further comprising:

removing the apparatus from the instrument by pressing a top plate of the apparatus toward the backside of the instrument; and securing a second pickup apparatus to the backside of the instrument by passing the second pickup apparatus through the backside of the instrument.

17. The method of claim 16, further comprising:

rotating a second top plate of the second apparatus to align a third set of pickups embedded in the second top plate with strings of the instrument.

18. An apparatus for selecting between sets of pickups for a stringed musical instrument comprising:

a top plate, wherein the top plate includes two sets of pickups embedded on a first side of the top plate;

a back plate, wherein the top plate is rotationally attached to the back plate;

a first mid-plate between the top plate and the back plate, wherein the first mid-plate is coupled to the top plate such that the first mid-plate rotates in unison with the top plate;

a second mid-plate between the first mid-plate and the back plate, wherein the second mid-plate is coupled to the back plate such that the first mid-plate rotates relative to the second mid-plate, wherein the first mid-plate includes an electrical contact on a side of the first mid-plate that faces the back plate and the second mid-plate includes a corresponding electrical contact on a side of the second mid-plate that faces the top plate, wherein the electronic contact on the first mid-plate is electronically connected to an pickup;

an electrical connector, wherein the electronic contact on the second mid-plate is electronically connected to the electronic connector, wherein the electrical connector corresponds to an electrical link of the instrument, wherein the electrical connector enables a selective electrical connection between the pickups and the instrument; and an attachment structure, wherein the attachment structure corresponds to an attachment portion of a backside the instrument opposite a stringed side of the instrument, wherein the attachment structure enables fastening of the apparatus to the instrument, wherein the top plate and the back plate are arranged such that when the apparatus is fastened to the instrument, the apparatus extends through a body of the instrument such that the first side of the top plate is adjacent strings of the instrument.

19. The apparatus of claim 18, wherein the electrical contact on the second mid-plate comprises a spring-loaded electrical contact, wherein the electrical contact on the first mid-plate is positioned in a recess in the first mid-plate such that an electrical connection is formed between the second mid-plate and first mid-plate when a spring of the spring-loaded electrical contact presses the contact on the second mid-plate into the recess.

20. The apparatus of claim 18, wherein a portion of the first mid-plate surrounding the electrical contact is grounded.

* * * * *